US007238032B2

(12) United States Patent
Pabst et al.

(10) Patent No.: US 7,238,032 B2
(45) **Date of Patent: *Jul. 3, 2007**

(54) CONNECTOR ARRANGEMENT BETWEEN A FLAT FLEX CABLE AND A COMPONENT

(75) Inventors: Thomas B. Pabst, Nuremberg (DE); Hans-Otto Geltsch, Berg-Sindlbach (DE); Harald Pankau, Fürth (DE)

(73) Assignee: FCI, Versailles (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/433,167

(22) Filed: May 12, 2006

(65) Prior Publication Data

US 2006/0292900 A1 Dec. 28, 2006

Related U.S. Application Data

(63) Continuation-in-part of application No. 10/532,838, filed as application No. PCT/EP03/12004 on Oct. 29, 2003, now Pat. No. 7,144,256.

(51) Int. Cl.
*H01R 12/00* (2006.01)

(52) U.S. Cl. ..... 439/67

(58) Field of Classification Search ..... 439/67, 439/329, 495, 354, 358
See application file for complete search history.

(56) References Cited

U.S. PATENT DOCUMENTS 4,252,392 A 2/1981 Whiteman, Jr. ..... 339/74
4,715,827 A * 12/1987 Furman ..... 439/465
5,297,968 A 3/1994 Johnson et al. ..... 439/67
5,743,755 A * 4/1998 Aoki ..... 439/354

FOREIGN PATENT DOCUMENTS

| | | |
|---|---|---|
| DE | 1 920 988 | 11/1970 |
| DE | 101 115 283 C1 | 3/2001 |
| EP | 0 339 701 | 11/1989 |
| EP | 0 443 655 A1 | 8/1991 |
| EP | 0 509 380 A2 | 10/1992 |
| EP | 1 150 384 A2 | 10/2001 |
| EP | 1 154 524 A1 | 11/2001 |

* cited by examiner

*Primary Examiner*—Phuong Dinh
(74) *Attorney, Agent, or Firm*—Harrington & Smith, PC

(57) ABSTRACT

An electrical connector assembly including a plug assembly and a socket assembly. The plug assembly includes a first flex cable and a first housing, and a biasing member. The socket assembly includes a second flex cable and a second housing. The plug assembly is adapted to be inserted into the socket assembly to electrically connect the first flex cable to the second flex cable. The biasing member is adapted to be contacted by a portion of the second housing to move the first flex cable out of an aperture of the first housing.

24 Claims, 11 Drawing Sheets

CONNECTOR ARRANGEMENT BETWEEN A FLAT FLEX CABLE AND A COMPONENT

CROSS REFERENCE TO RELATED APPLICATION

This a continuation-in-part patent application of U.S. application Ser. No. 10/532,838 filed Apr. 19, 2005, now U.S. Pat. No. 7,144,256 which is a national stage application of International Application No. PCT/EP03/12004 filed Oct. 29, 2003, which are hereby incorporated by reference in their entireties.

BACKGROUND OF THE INVENTION

1. Field of the Invention

The present invention relates to a connector arrangement between a flat flex cable and a component of an electrical circuit or another flat flex cable.

2. Brief Description of Prior Developments

EP 0443655 A1 describes a connector arrangement between a flat flex cable and a component of an electrical circuit. Flat flex cables are finding ever-increasing application in bus systems—for example, in automobile manufacture. There, flat flex cables, which are connected to form ring circuits and by means of which a multiplex control of diverse components occurs, replace costly and, in particular, heavy-weight cable harnesses.

Known from EP 02006691 is a connector arrangement for flat flex cables by means of which two such ribbon cables are connected to each other. For this purpose, respective conductor strands are stripped of insulation at the connecting site between the ribbon cables and these sites are pressed together by a clamp under application of an elastic pressure. This simple method of connection has proven itself useful, but can be applied only to a connection of flat flex cables placed under one another.

The present invention is based on the problem of further developing a generic connector arrangement in such a way that, with it, flat flex cables can be manufactured with circuit boards as well.

The present invention is based on the basic idea of affixing a housing to a cable end of the connecting flexible ribbon, in which the region that is to be contacted is subjected to an elastic spring force, by means of which this region is pressed against the contact surfaces of a mating connector.

SUMMARY OF THE INVENTION

In accordance with one aspect of the present invention, an electrical connector assembly is provided including a plug assembly and a socket assembly. The plug assembly includes a first flex cable and a first housing, and a biasing member. The socket assembly includes a second flex cable and a second housing. The plug assembly is adapted to be inserted into the socket assembly to electrically connect the first flex cable to the second flex cable. The biasing member is adapted to be contacted by a portion of the second housing to move the first flex cable out of an aperture of the first housing.

In accordance with another aspect of the invention, a connector arrangement between a flat flex cable and an electrical component, the connector arrangement is provided comprising a first housing connected to an end of the flat flex cable; at least biasing member connected to the first housing; and a second housing connected to the electrical component, wherein the second housing member forms a cavity adapted to receive the first housing therein. The flat flex cable comprises a plurality of conductors and electrical insulation surrounding and separating the conductors. The end of the flat flex cable comprises exposed contact regions on a first side of the flat flex cable. The at least one biasing member is located against an opposite second side of the end of the cable and presses the exposed contact regions into contact with electrical contact surfaces of the electrical component in the cavity formed by the second housing.

In accordance with another aspect of the invention, an electrical plug sub-assembly is provided comprising a first housing part having at least one aperture therethrough; a second housing part connected to the first housing part, wherein the first and second housing parts are adapted to capture a portion of a flat flex cable therebetween with a section of the flat flex cable having exposed contact regions being located at the at least one aperture, wherein the exposed contact regions are located on a first side of the cable facing outward at the at least one aperture; and at least one elastic biasing element connected to the second housing part. The at least one elastic biasing element comprises a metal member with at least one spring strip sized and shaped to be located between the first and second housing proximate the at least one aperture. The at least one elastic biasing element is adapted to contact an opposite side of the flat flex cable and push the cable outward into the at least one aperture.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
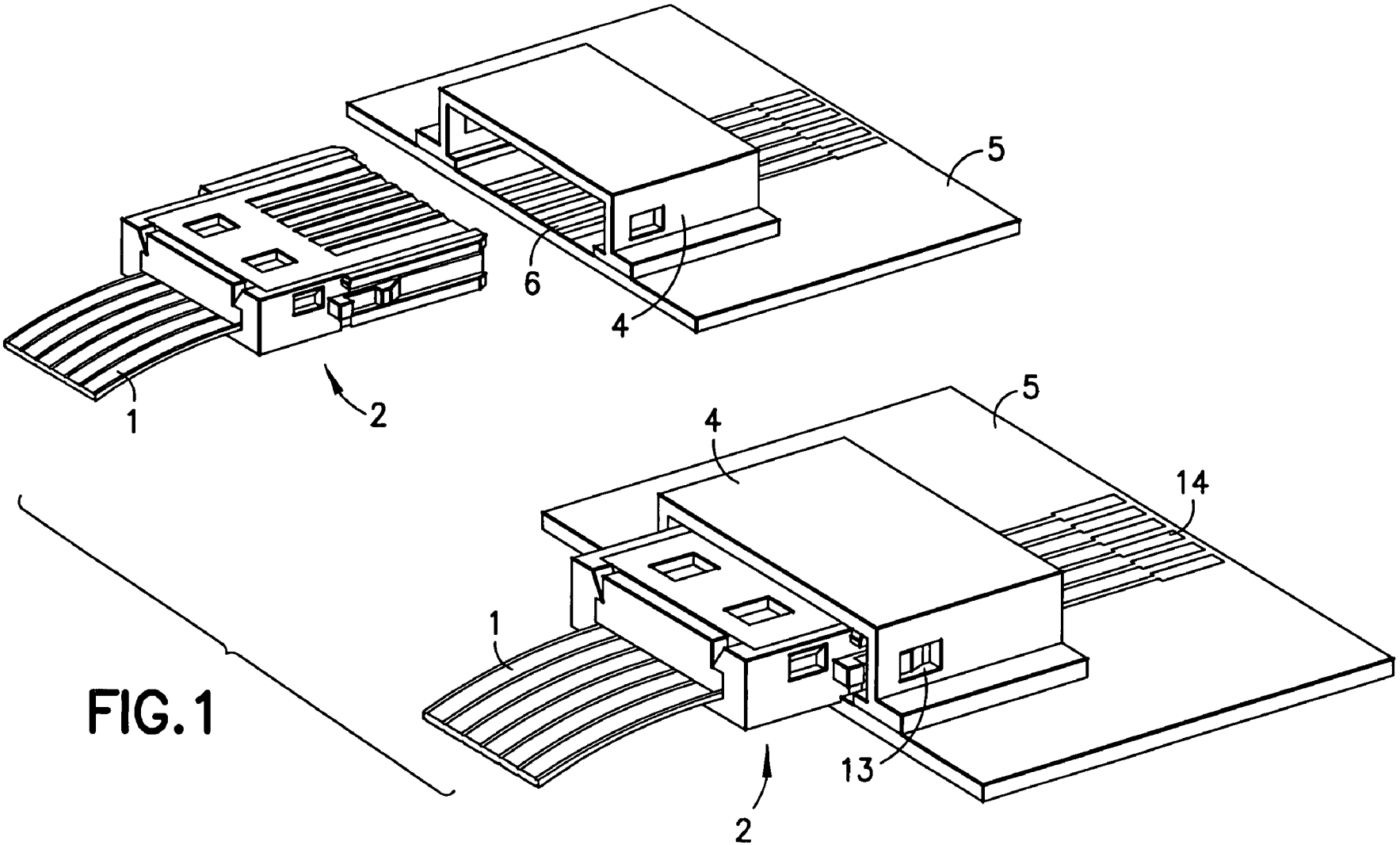
FIG. 1 shows a first embodiment example of a connector arrangement of the invention prior to connection and in contacted position.

Although the present invention will be described with reference to the exemplary embodiments shown in the drawings, it should be understood that the present invention can be embodied in many alternate forms of embodiments. In addition, any suitable size, shape or type of elements or materials could be used.

FIG. 1, top left, shows a flat flex cable 1, to the front end of which a housing 2 is attached. The housing 2 has an opening on its bottom, which is not visible here, through which regions of the flat flex cable 1 stripped of insulation protrude downward above the floor of the housing 2. An electrical component, a circuit board 5 in the example shown here, has conductive tracks with contact surfaces 6. An uptake 4 is attached to the circuit board 5 above these contact surfaces 6 by, for example, adhesive bonding. This uptake 4 has the form of a wide bracket that extends over the contact surfaces 6. The housing 2 is inserted into the empty space between the contact surfaces 6 and the upper cross wall of the bracket. This operation is shown in FIG. 1, bottom right. In its final position, the housing 2 is locked in the uptake 4 by catch arms that are affixed to the sides walls of the housing and that spring into a catch opening 13.

Figure 2:
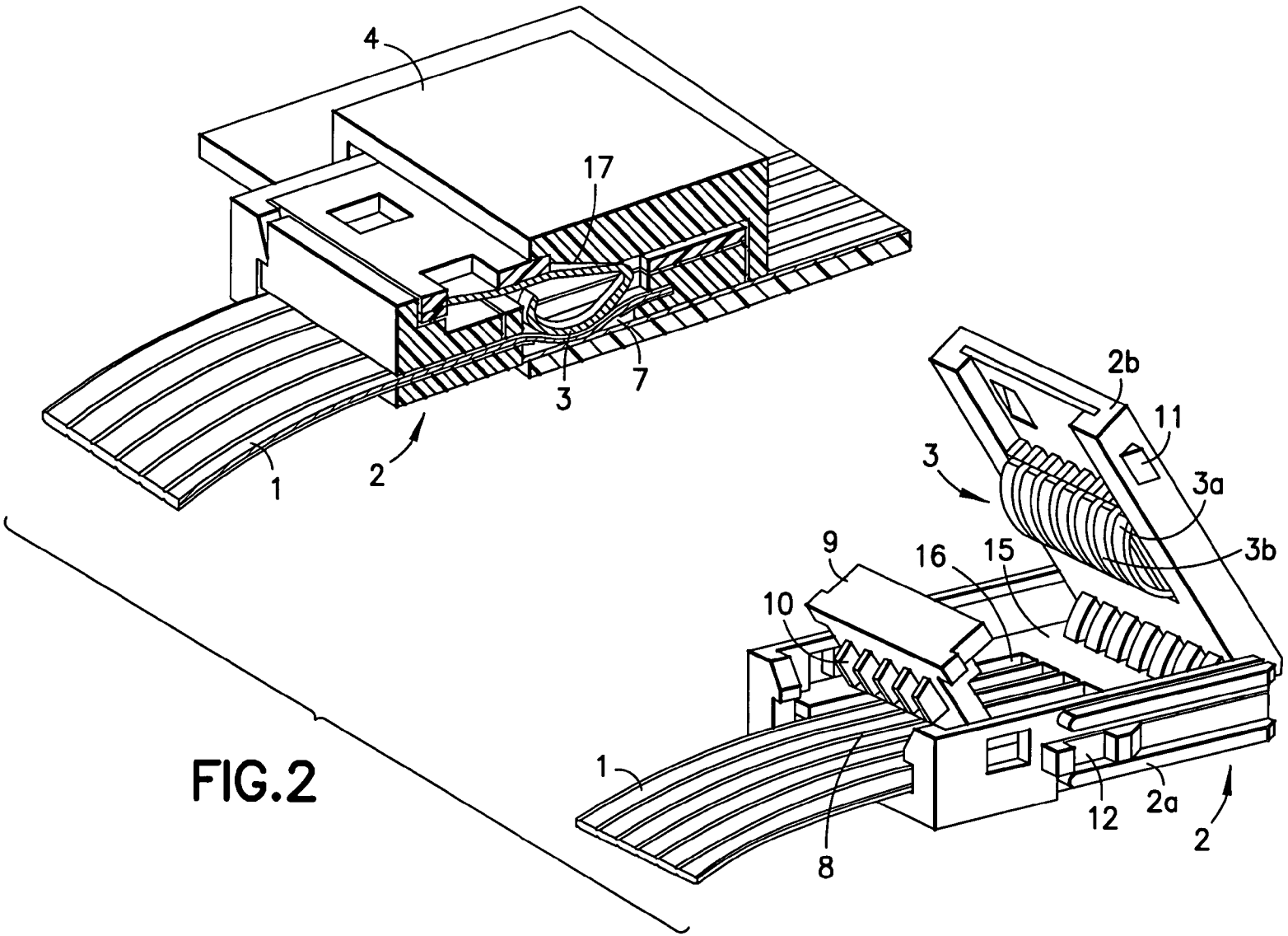
FIG. 2 shows the connector arrangement in perspective, partially cut away and in opened position.

FIG. 2, top left, shows the final position of the housing 2 in the uptake 4, partially cut away. Evident there is also the fact that the uptake 4 can also be closed on its front side. Attached to the inside of the housing 2 is a steel spring 3, the free end of which is bent back in a convex manner in a direction opposite to the plugging direction, so that, in the region of an opening 7 in the floor of the housing 2, the bulging region of the steel spring 3 presses on the flat flex cable 1 and the latter, with its conductive tracks that have been stripped of insulation in this region, presses through the opening 7 until these regions protrude above the floor.

When the housing 2 is inserted into the uptake 4, the pressing force exerted by the steel spring 3 is at first relatively small. Only toward the end of the motion of insertion does the back side of each steel spring 3 contact a ramp 17 that is constructed on the uptake and that bends the steel spring 3 further downward and thus produces the requisite contact force. In this way, an initially small insertion force and a lower wear due to friction against the contact surface is achieved. As can be seen in FIG. 1, it is possible to provide one opening per spring through which the spring is pressed by the one ramp for each steel spring 3; however, it is also possible to provide one ramp and one opening for all steel springs.

Shown in FIG. 2, bottom right, is the opened housing 2. The housing 2 consists of a bottom part 2*a*, into which the insertion end of the flat flex cable is inserted. The cable end has perforations 8 in defined relative positions with respect to the head end of the flat flex cable 1, in which the retaining pins 10 of a strain relief 9 engage. The latter is hinged to the body of the bottom part 2*a* of the housing 2 transverse to the lengthwise direction of the ribbon cable and can be pivoted after insertion of the flat flex cable 1 into the housing 2, thereby allowing the retaining pins 10 to engage in the perforations 8. In this position, the strain relief 9 is locked on the side flanks of the bottom part 2*a* of the housing 2. The top part 2*b* of the housing 2 is hinged in a pivoting manner to the front end of the bottom part 2*a* of the housing 2. The steel spring 3 is also attached in the top part. In the example shown here, the steel spring 3 takes the form of a comb; that is, a number of spring steel strips 3*a*, 3*b*, . . . , corresponding to the number of conductive tracks, are arranged parallel to one another, so that each conductive track being connected is subject individually to the pressure of its own steel strip spring. The guiding of the individual spring strips is achieved in the embodiment example shown by way of ribs arranged between them and by an intermediate plate 15 with slots 16, into which the spring arches of the individual spring strips 3*a*, 3*b* can dip during pivoted closure of the top housing part 2*b* and are laterally guided. The top part 2*b* of the housing 2 is also locked in the bottom part 2*a* via catches 11 and corresponding catch shoulders. The housing 2 is guided through the uptake 4 with little play, so that the exposed conductor regions are pressed on corresponding contact surfaces 6 of the circuit board shown in FIG. 1 owing to an elastic spring force. A simple and secure contacting is ensured in this way.

The description of this embodiment example of the present invention serves only for purposes of illustration and is not to be understood as being limiting.

Figure 3:
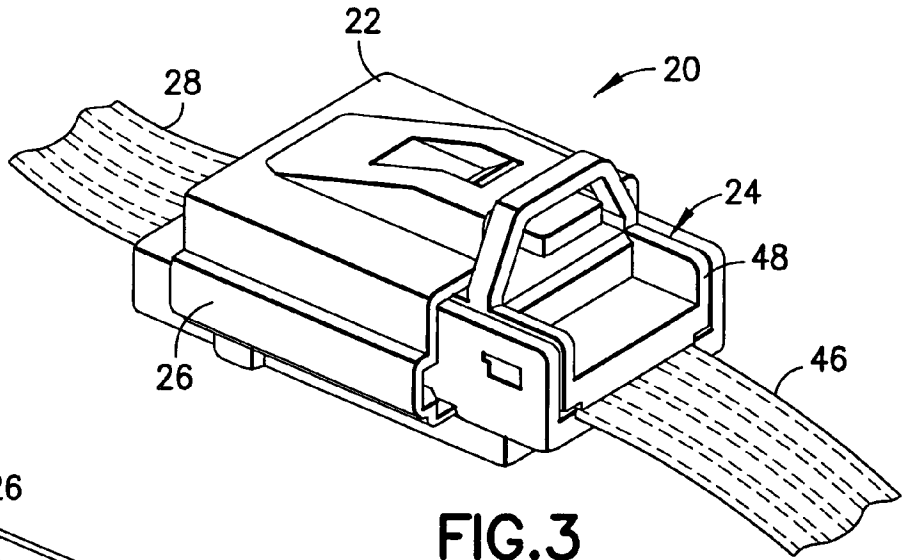
FIG. 3 is a perspective view of a connector assembly incorporating features of the invention.
Figure 4:
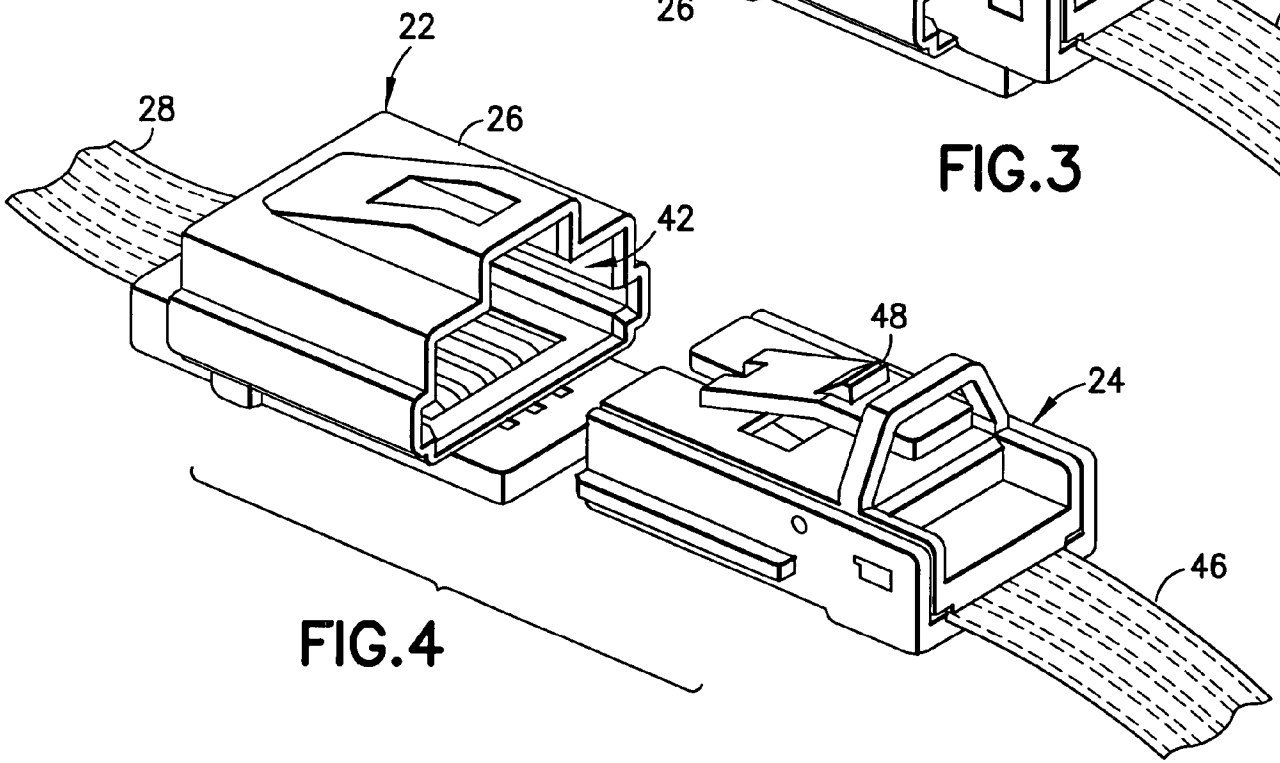
FIG. 4 shows sub-assemblies of the connector assembly shown in FIG. 3 before connection.
Figure 5:
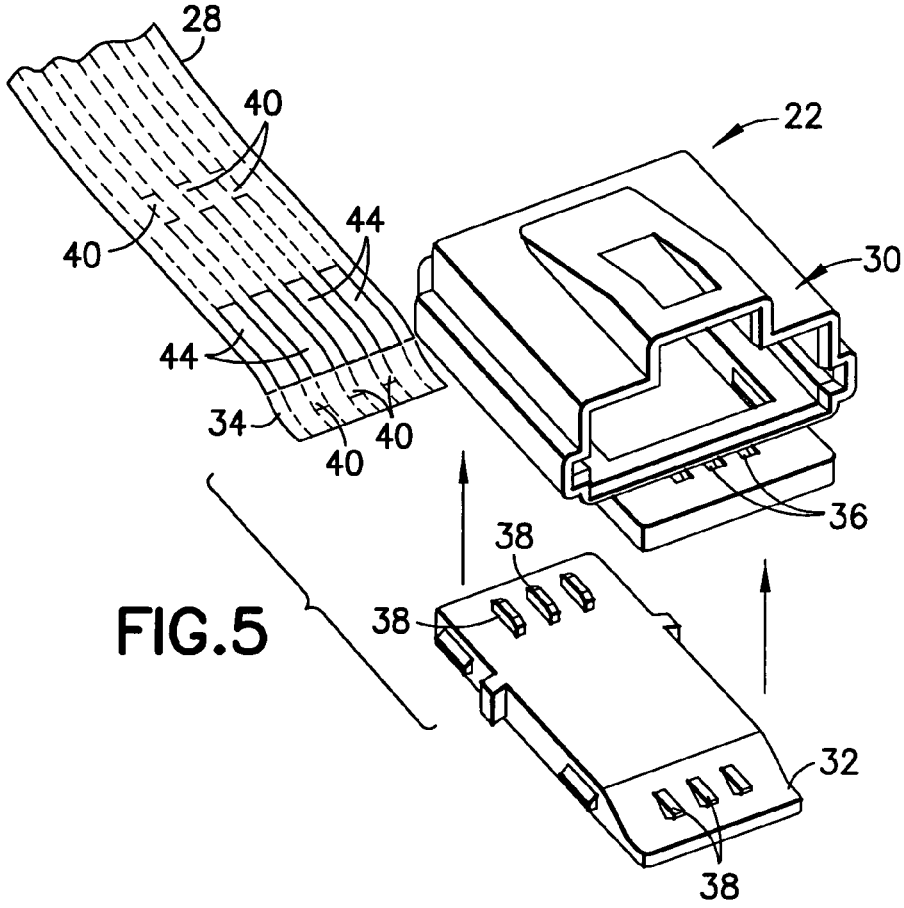
FIG. 5 is an exploded perspective view of a socket assembly shown in FIGS. 3 and 4.

Referring now also to FIG. 3, a perspective view of an alternate embodiment of the connector assembly is shown. The connector assembly 20 generally comprises a first assembly 22 mated to a second connector 24. Referring also to FIGS. 4 and 5, the first assembly 22 generally comprises a first housing 26 and a first flex cable 28. The first housing 26 comprises a first housing member 30 and a second housing member 32. The two housing members are preferably comprises of plastic, but any suitable material(s) could be used. In addition, more or less than two housing members could be provided.

Figure 6:
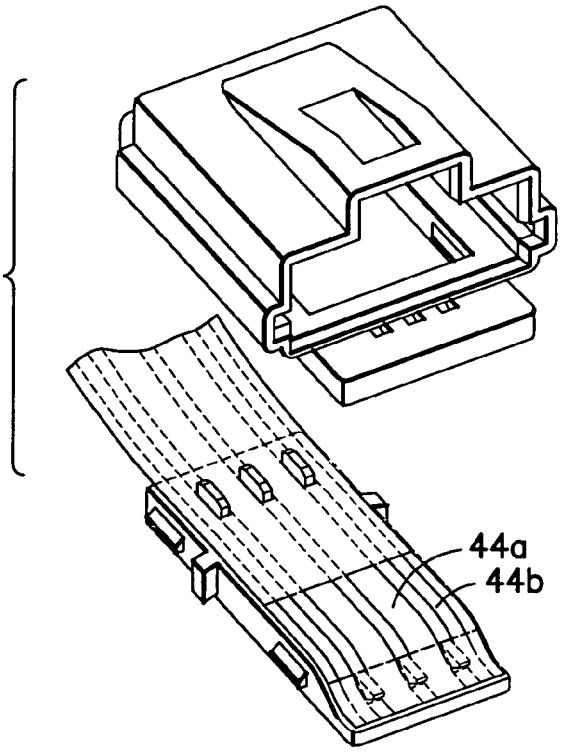
FIG. 6 is an exploded perspective view of an alternate embodiment of the socket assembly shown in FIG. 5.

The second housing member 32 is snap-lock connected to a bottom side of the first housing member 30 with the end 34 of the first flex cable 28 captured between the two housing members. The housing 26 forms a receiving cavity 42 for receiving the second assembly 24. The first housing member 30 has locating slots 36. The second housing member 32 has locating projections 38. The projections 38 extend through slots 40 in the flex cable 28 and into the slots 36 to hold the end 34 of the cable 28 at a stationary position in the housing 26 at a bottom side of the cavity 42. The end 34 of the flex cable 28 has exposed contact surfaces or pads 44 which face the cavity 42. In this embodiment the flex cable 28 has four equal sized and spaced pads 44. However, as shown in the alternate embodiment of FIG. 6, the pads 44*a*, 44*b* could have different sizes. Also, more or less than four pads could be provided.

Figure 7:
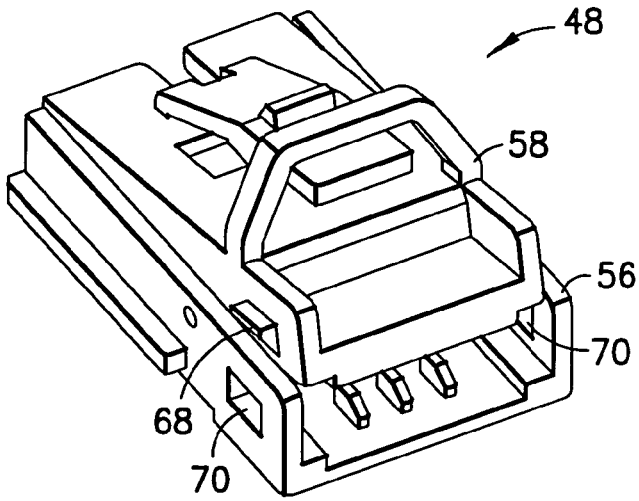
FIG. 7 is a perspective view of the housing of the plug assembly shown in FIGS. 3 and 4.
Figure 8:
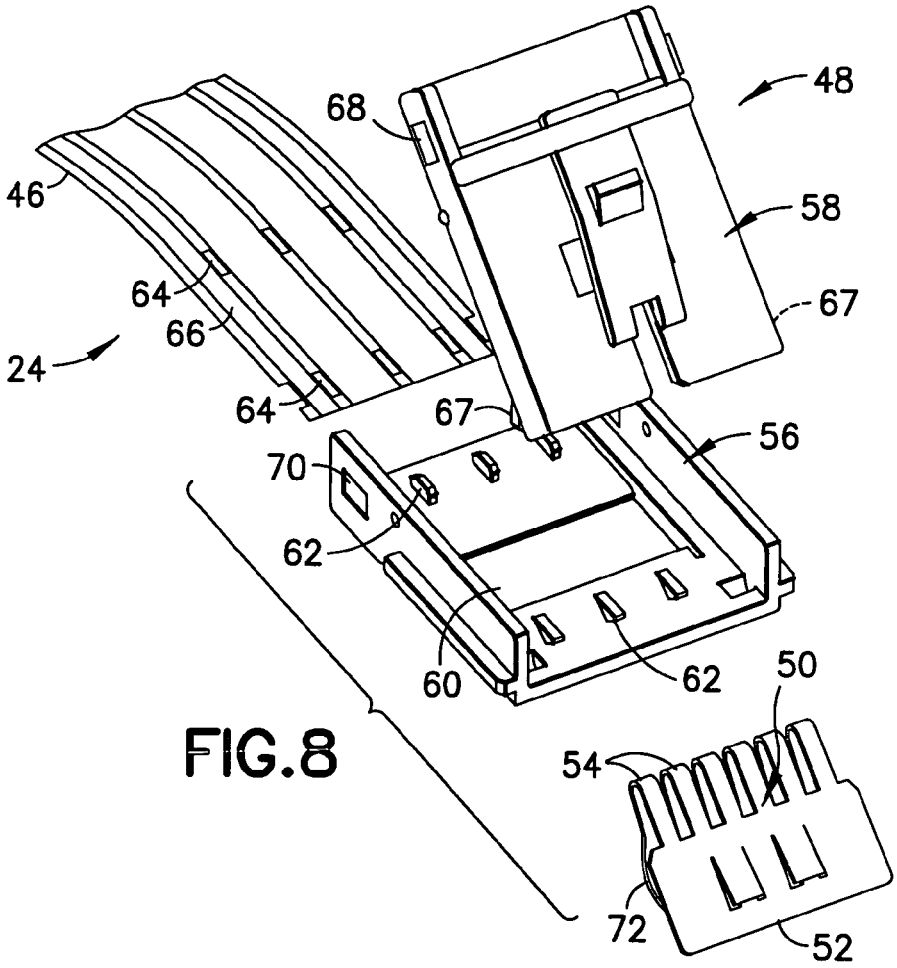
FIG. 8 is an exploded perspective view of the plug assembly shown in FIGS. 3 and 4.

Referring also to FIGS. 7 and 8, the second assembly 24 generally comprises a second flex cable 46, a second housing 48 and a biasing member 50. In this embodiment the biasing member 50 comprises a one-piece metal spring member. However, in alternate embodiments, the biasing member could comprise more than one member and/or could be comprises of material(s) other than metal, such as plastic for example. The biasing member 50 has a general comb-like shape with a base 52 and a plurality of resiliently deflectable fingers 54. As seen best in FIG. 9, the base 52 fixedly attaches the biasing member 50 to the housing 48. The fingers 54 extend rearward from the base 52, curve downward and forward about 180 degrees, and then extend forward with a general serpentine shape. However, in alternate embodiments, any suitable shape of the fingers or the biasing member(s) could be provided.

Figure 9:
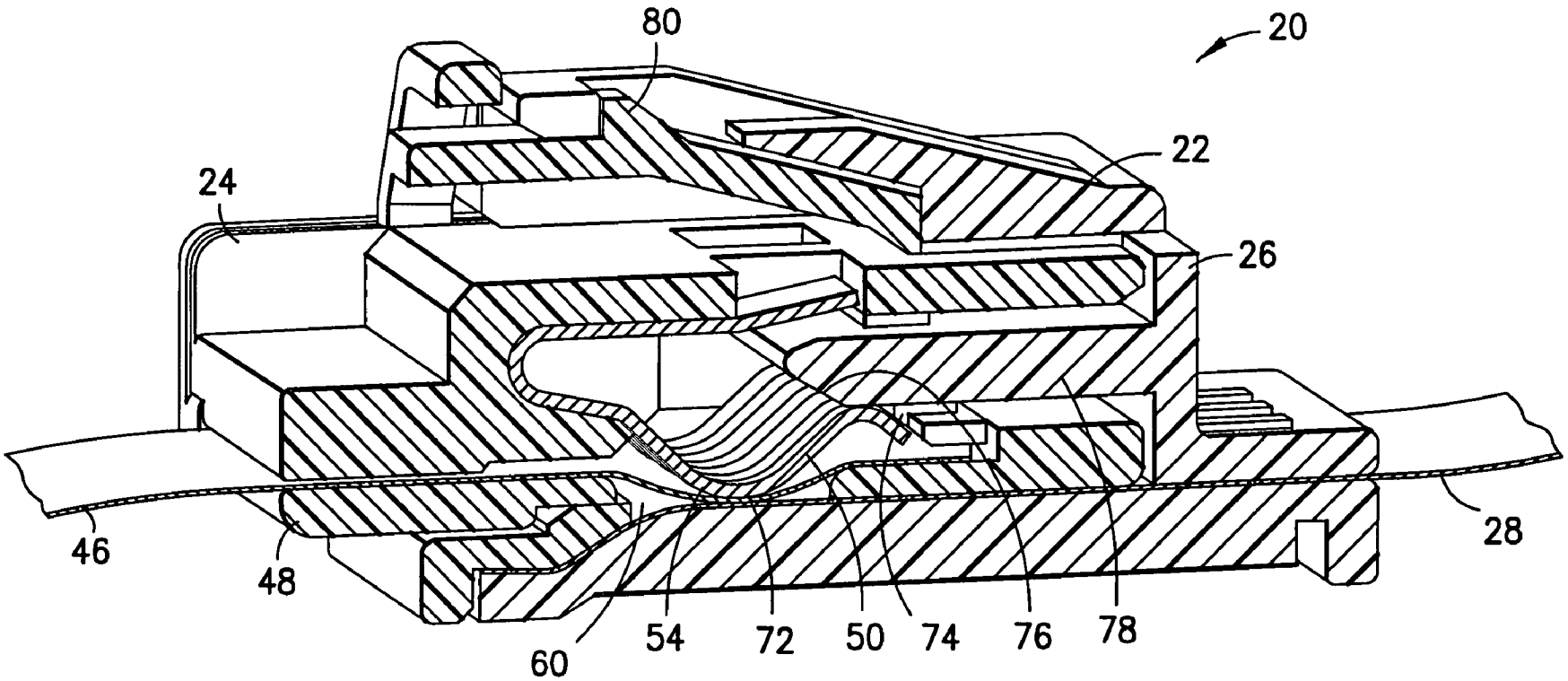
FIG. 9 is a cross sectional view of the connector assembly shown in FIG. 3.
Figure 10:
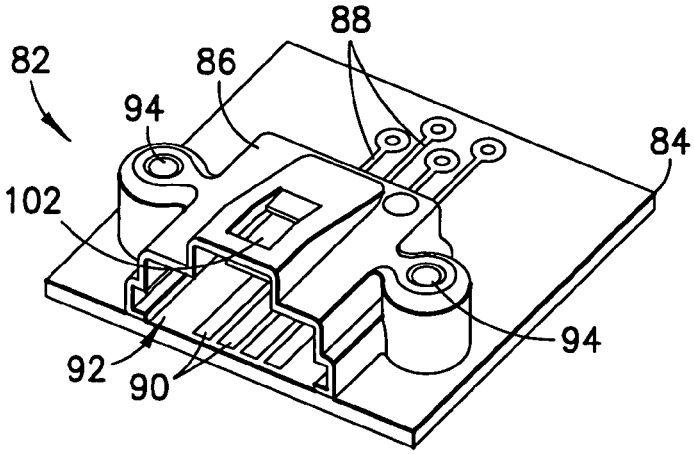
FIG. 10 is a perspective view of another alternate embodiment of a socket assembly comprising features of the invention.
Figure 11:
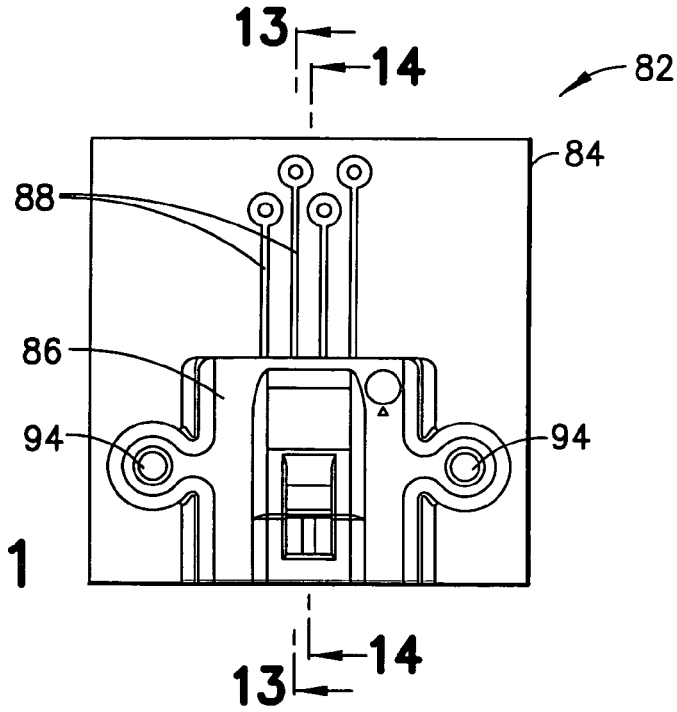
FIG. 11 is a top plan view of the socket assembly shown in FIG. 10.
Figure 12:
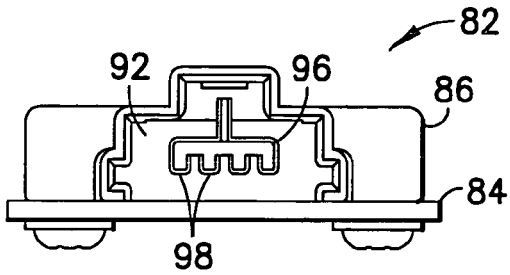
FIG. 12 is a front elevational view of the socket assembly shown in FIG. 10.
Figure 13:
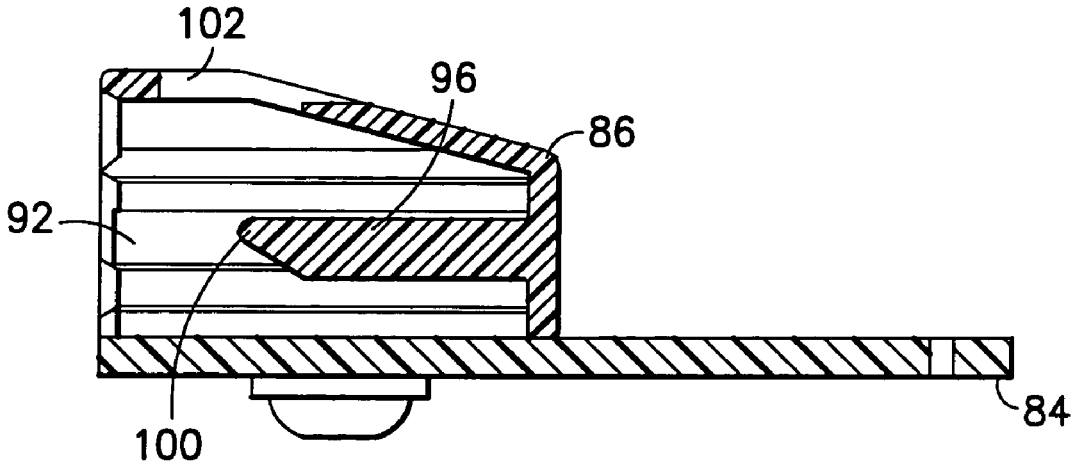
FIG. 13 is a cross sectional view of the socket assembly shown in FIG. 11 taken along line 13-13.
Figure 14:
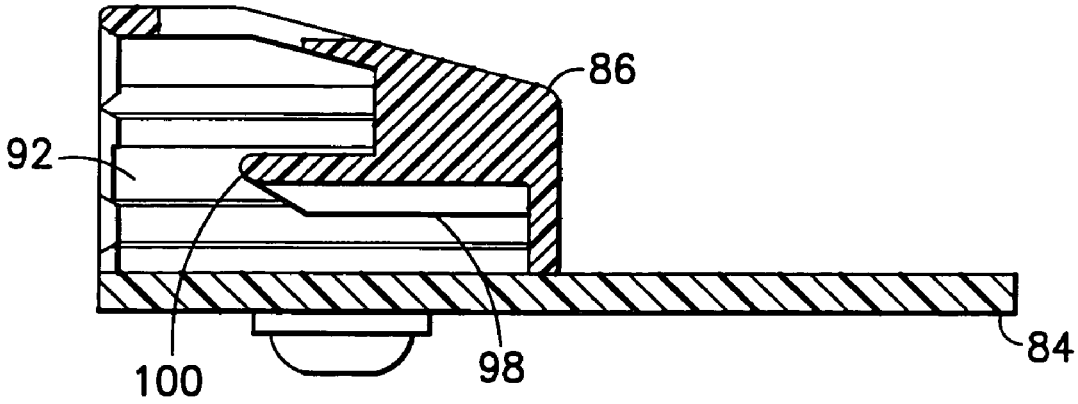
FIG. 14 is a cross sectional view of the socket assembly shown in FIG. 11 taken along line 14-14.

The second housing 48 comprises a first housing member 56 and a second housing member 58. The two housing members are preferably comprises of plastic, but any suitable material(s) could be used. In addition, more or less than two housing members could be provided. The first housing member 56 forms a base with an access slot 60 and locating projections 62. The second flex cable 46 has holes 64. The projections 62 are located in the holes 64 to locate the end 66 of the second flex cable 46 to the second housing 48 and at the access slot 60. The second housing member 58 is pivotably attached to the front end of the first housing member 56 at pivots 67. The rear end of the second housing member 58 has snap-lock latches 68 which are adapted to engage the snaplock holes 70 in the first housing member 56 when the second housing member is snapped into a closed position to lock the second flex cable 46 to the second housing 48. As seen in FIG. 9, when the components of the second assembly 24 are assembled, the end portions 72 of the fingers 54 can bias portions of the second flex cable 46 into the access slot 60.

Referring to FIG. 9, a cross sectional view of the connector assembly 20 is shown. The two assemblies 22, 24 are used to mechanically and electrically connect the two flex cables 28, 46 to each other. More specifically, after the first housing 26 is connected to the first flex cable 28, and after the second housing 48 and the biasing member 50 are connected to the second flex cable 46, the two assemblies 22, 24 are connected to each other by inserting the second assembly 24 into the cavity 42 of the first assembly 22. As the second assembly 24 is inserted into the receiving cavity 42, the ramp shaped ends 74 of the fingers 54 contact a wedging ramp shaped surface 76 of a projection 78 of the first housing member 30 and are wedged downward. This causes the end portions 72 to press the second flex cable 46 out of the access slot 60 and press the contact pads of the second flex cable 46 into contact with the contact pads of the first flex cable 28. The second housing 48 has a snap-lock latch 80 which engages the first housing 26 to removably retain the two assemblies 22, 24 together.

Referring also to FIGS. 10-14 an alternate embodiment of a socket assembly 82 for receiving the plug assembly 24 is shown. The socket assembly 82 generally comprises an electronic component 84, such as a printed circuit board (PCB), and a housing member 86. The printed circuit board 84 has conductor traces 88 with contact sections 90 located in a cavity 92 formed by the housing member 86. The housing member 86 is attached to the top surface of the printed circuit board 84 by fasteners 94. The housing member 86 has a projection 96 with a comb shaped front profile as seen best in FIG. 12. The projection 96 has downward extending sections 98 that form the general comb shaped profile. The projection 96, including the sections 98, form a forward facing ramp surface 100 for wedging the fingers of the biasing member 50 downward as the plug assembly 24 is inserted into the cavity 92 to press the contact pads of the flex cable 46 into electrical contact with the contact sections 90 of the conductor traces 88. The housing member 86 also comprises an aperture 102 for the latch 80.

Figure 15:
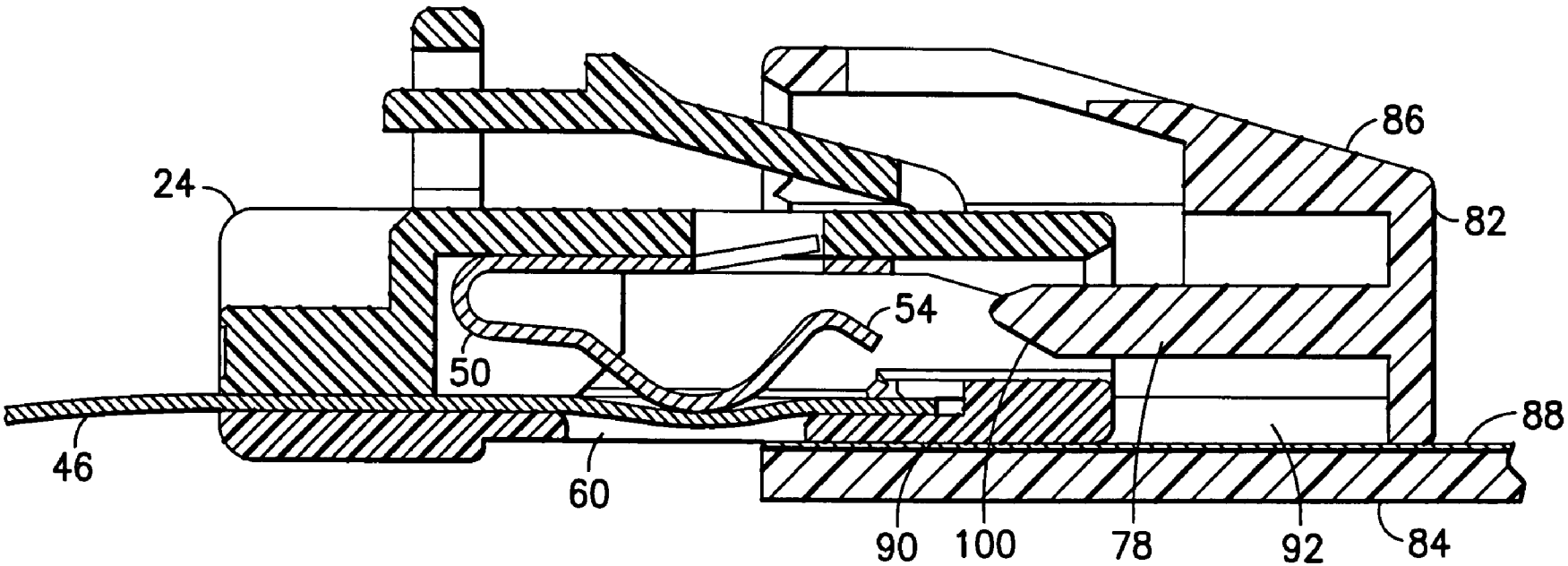
FIG. 15 is a cross sectional view of the plug assembly shown in FIGS. 7-8 and the socket assembly of FIGS. 10-14 being assembled.
Figure 16:
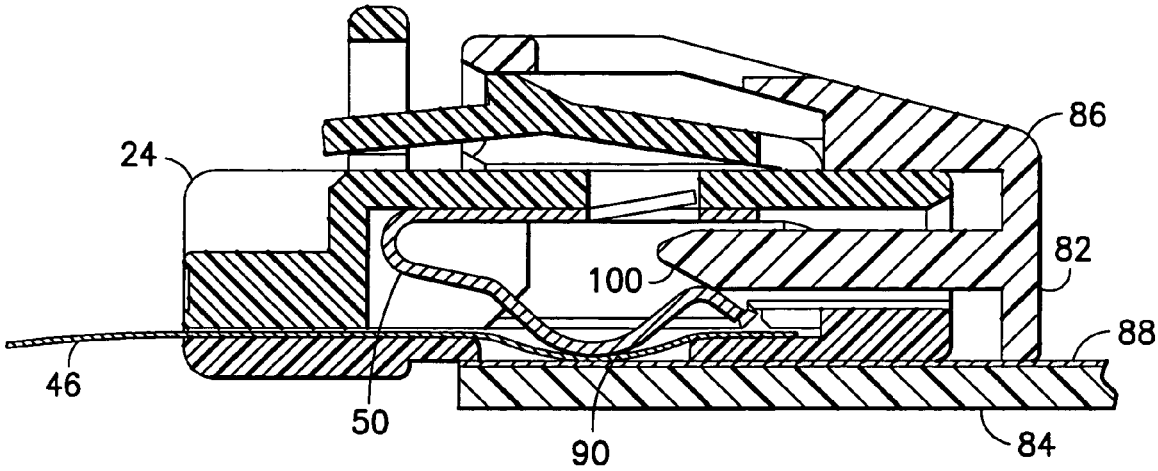
FIG. 16 is a cross sectional view as in FIG. 15 with the plug assembly further inserted into the socket assembly.
Figure 17:
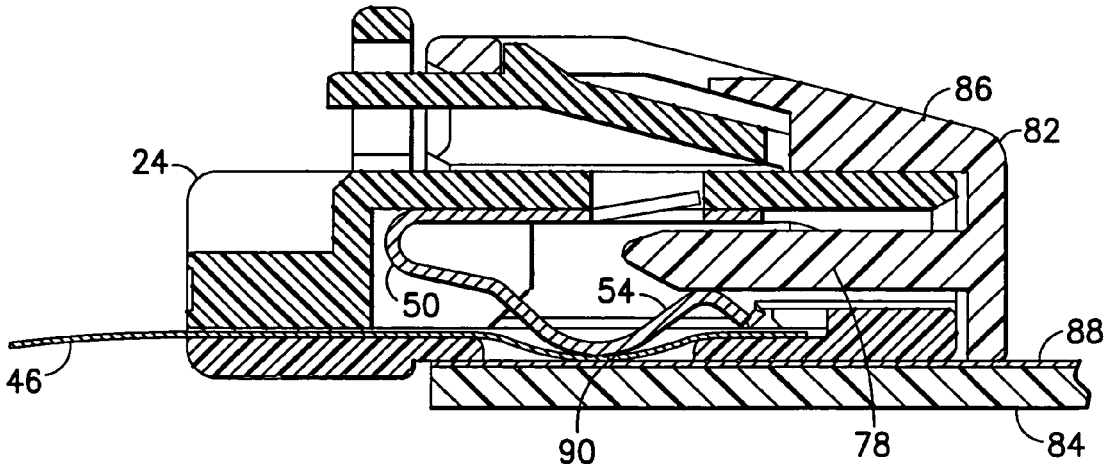
FIG. 17 is a cross sectional view as in FIG. 16 with the plug assembly further inserted into the socket assembly into a final inserted position.

Referring also to FIGS. 15-17, the plug assembly 24 is shown being connected to the socket assembly 82. As can be seen in FIG. 15, before the fingers 54 of the biasing member 50 contact the ramp surface 100 of the projection 78, the flex cable 46 does not project out of the access slot 60. However, with further insertion of the plug assembly 24 into the cavity 92, the ends of the finger 54 contact the ramp surface 100. As seen in FIG. 16, this causes the fingers 54 to deflect downward and press the flex cable 46 out of the access slot 60 and against the top side of the printed circuit board 88. When the plug assembly 24 is fully inserted as shown in FIG. 17, the contact pads on the flex cable 46 are pressed by the biasing member 50 against the contact sections 90 of the PCB 88 with the fingers under a flat section of the projection 78.

Figure 18:
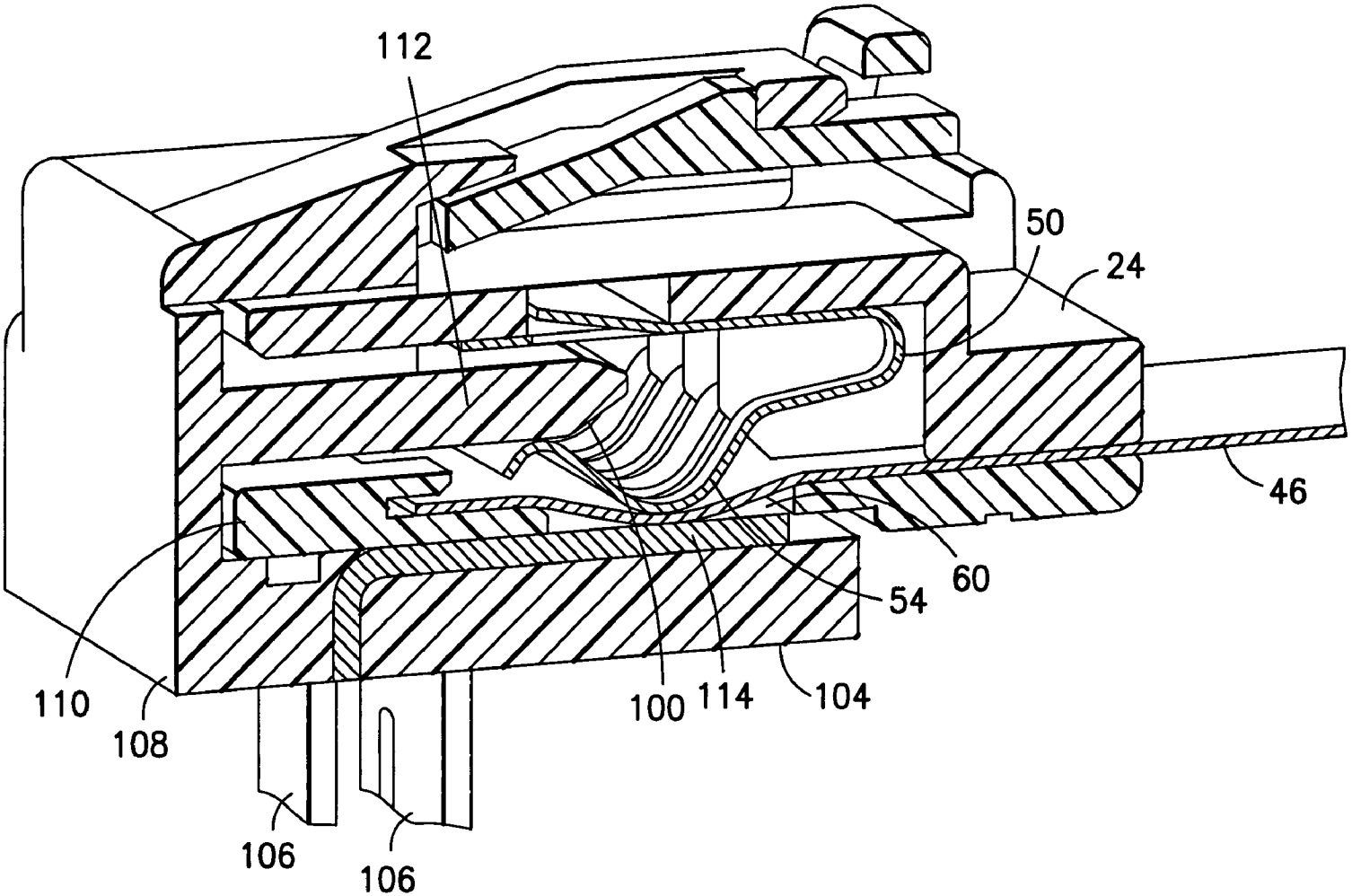
FIG. 18 is a cut away of a perspective view of plug assembly and an alternate embodiment of the socket assembly connected to each other.

Referring also to FIG. 18, there is shown a perspective view with a cut away of the plug assembly 24 connected to an alternate embodiment of the socket assembly. In this embodiment the electrical connector socket assembly 104 comprises a plurality of electrical contacts 106 and a housing 108. In this embodiment the housing 108 is overmolded onto the electrical contacts 106. However, in alternate embodiments any suitable means for connecting the contacts to the housing could be provided. The housing 108 comprises a plug receiving area 110 with at least one projection 112 extending into the plug receiving area 110. The projection 112 is identical to the projection 78 with a ramp surface 100.

The contacts 106 each comprise a first contact section 114 with a contact surface facing and adjacent plug receiving area 110. The contacts 106 extend out of the housing 108 for connection to another component or conductors. As seen in FIG. 18, when the plug assembly 24 is inserted into the plug receiving area 110 of the socket connector 104, the fingers 54 of the biasing spring 50 contact the ramp surface(s) 100 of the projection(s) 112, and deflect the fingers 54 outward to move the electrical contact surfaces of the conductors of the flex cable 46 out of the access slot 60 and into electrical contact with the first contact sections 114 of the contacts 106. This embodiment illustrates that the invention can be used with a socket assembly having electrical contacts as its electrical conductors, as well as a socket assembly with conductive traces (such as on a PCB) as its electrical conductors, and/or a socket assembly having a flex cable. These are only some examples. Other alternatives could be provided, such as a component having an integrally formed plug receiving area for example, or for use with a different type of plug assembly for example. In one type of alternate embodiment the biasing member could be integrally formed with one of the housing members of the plug housing.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector assembly comprising:

a plug assembly comprising a first flex cable and a first housing, and a biasing member;

a socket assembly comprising a second flex cable and a second housing, wherein the plug assembly is adapted to be inserted into the socket assembly to electrically connect the first flex cable to the second flex cable, wherein the biasing member is adapted to be contacted by a portion of the second housing to move the first flex cable out of an aperture of the first housing.

2. An electrical connector assembly as in claim 1 wherein the first housing comprises a first housing member having the aperture, and a second housing member pivotably connected to the first housing member.

3. An electrical connector assembly as in claim 1 wherein the biasing member is fixedly attached to the second housing member.

4. An electrical connector assembly as in claim 1 wherein the biasing member comprises a metal spring.

5. An electrical connector assembly as in claim 4 wherein the metal spring has a form of a comb with spring steel strips parallel to one another.

6. An electrical connector assembly as in claim 1 wherein the biasing member comprises a plurality of metal springs, each spring pressing against insulation on a second side of the first flex cable directly opposite a respective exposed contact region on a first side of the first flex cable.

7. An electrical connector assembly as in claim 1 wherein the biasing member comprises a bent back free end.

8. An electrical connector assembly as in claim 1 wherein electrical insulation of the first flex cable has perforations, and the first housing has retaining projections located in the perforations which form a strain relief.

9. An electrical connector assembly as in claim 1 wherein, when the first housing and the biasing member are inserted into the second housing, at an end of insertion the biasing member contacts a ramp on the second housing to press the biasing member against the first flex cable.

10. A connector arrangement between a flat flex cable and an electrical component, the connector arrangement comprising:

a first housing connected to an end of the flat flex cable;

at least one biasing member connected to the first housing; and a second housing connected to the electrical component, wherein the second housing member forms a cavity adapted to receive the first housing therein, wherein the flat flex cable comprises a plurality of conductors and electrical insulation surrounding and separating the conductors, wherein the end of the flat flex cable comprises exposed contact regions on a first side of the flat flex cable, wherein the at least one biasing member is located against an opposite second side of the end of the cable and presses the exposed contact regions into contact with electrical contact surfaces of the electrical component in the cavity formed by the second housing.

11. A connector arrangement as in claim 10 wherein the at least one biasing member comprises a metal spring.

12. A connector arrangement as in claim 11 wherein the metal spring has a form of a comb with spring steel strips parallel to one another.

13. A connector arrangement as in claim 10 wherein the at least one biasing member comprises a plurality of metal springs, each spring pressing against the insulation on the second side of the cable directly opposite one of the exposed contact regions.

14. A connector arrangement as in claim 10 wherein the at least one biasing member comprises a bent back free end.

15. A connector arrangement as in claim 10 wherein the first housing comprises a bottom part and a top part, wherein the at least one biasing member is connected to the top part, and wherein the top part is pivotably connected to the bottom part.

16. A connector arrangement as in claim 10 wherein the electrical insulation of the cable has perforations, and the first housing has retaining projections located in the perforations which form a strain relief.

17. A connector arrangement as in claim 10 wherein the at least one biasing member is directly contacted by the second housing.

18. A connector arrangement as in claim 17 wherein, when the first housing and the at least one biasing member are inserted into the second housing, at an end of insertion the at least one biasing member contacts a ramp on the second housing to press the at least one biasing member against the flat flex cable.

19. An electrical plug sub-assembly comprising:

a first housing part having at least one aperture therethrough;

a second housing part connected to the first housing part, wherein the first and second housing parts are adapted to capture a portion of a flat flex cable therebetween with a section of the flat flex cable having exposed contact regions being located at the at least one aperture, wherein the exposed contact regions are located on a first side of the cable facing outward at the at least one aperture; and at least one elastic biasing element connected to the second housing part, wherein the at least one elastic biasing element comprises a metal member with at least one spring strip sized and shaped to be located between the first and second housing proximate the at least one aperture, wherein the at least one elastic biasing element is adapted to contact an opposite side of the flat flex cable and push the cable outward into the at least one aperture.

20. Electrical connection components as in claim 19 wherein the first housing part is pivotably connected to the second housing part.

21. Electrical connection components as in claim 19 wherein the second housing part comprises at least one opening at a portion of the at least one elastic biasing element to allow a housing of an electrical component, which the electrical connection components are adapted to be at least partially inserted into, to press against the at least one elastic element.

22. Electrical connection components as in claim 19 wherein the at least one elastic biasing element comprises a comb with spring steel strips parallel to one another.

23. Electrical connection components as in claim 19 wherein the spring steel strips comprise bent back free ends.

24. An electrical connector assembly comprising:

a plug assembly comprising a first flex cable, a first housing and at least one biasing member; and a socket assembly comprising a second housing and at least one electrical conductor on the second housing, wherein the plug assembly is adapted to be inserted into the socket assembly to electrically connect the first flex cable to the at least one electrical conductor, wherein the at least one biasing member is adapted to be contacted by a portion of the second housing to move the first flex cable at least partially through an aperture of the first housing to electrically connect the first flex cable to the at least one electrical conductor of the socket assembly.

* * * * *